US009020182B2

(12) United States Patent
Lin et al.

(10) Patent No.: US 9,020,182 B2
(45) Date of Patent: Apr. 28, 2015

(54) REMOVABLE SPEAKER STRUCTURE FOR ELECTRONIC DEVICE

(71) Applicant: Wistron Corporation, New Taipei (TW)

(72) Inventors: Cheng-Hung Lin, New Taipei (TW); Kuo-Wei So, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 14/055,016

(22) Filed: Oct. 16, 2013

(65) Prior Publication Data

US 2014/0226848 A1 Aug. 14, 2014

(30) Foreign Application Priority Data

Feb. 8, 2013 (TW) ..... 102202942 U

(51) Int. Cl.
*H04R 1/02* (2006.01)

(52) U.S. Cl.
CPC ..... *H04R 1/025* (2013.01); *H04R 2499/15* (2013.01)

(58) Field of Classification Search
USPC ..... 381/386, 388, 189
See application file for complete search history.

(56) References Cited

U.S. PATENT DOCUMENTS 4,953,223 A * 8/1990 Householder ..... 381/387
5,604,663 A 2/1997 Shin et al.

* cited by examiner

*Primary Examiner* — Davetta W Goins
*Assistant Examiner* — Amir Etesam
(74) *Attorney, Agent, or Firm* — Rosenberg, Klein & Lee

(57) ABSTRACT

The present invention provides a removable speaker structure for electronic device, which uses the space for the optical disk drives in electronic devices such as notebook computers or in docking stations. After removing the optical disk drive, the removable speaker can be placed. The removable speaker comprises a main module and a speaker module. The speaker module can be removed form the main module for playing multimedia data and enhancing its sound effects.

11 Claims, 9 Drawing Sheets

REMOVABLE SPEAKER STRUCTURE FOR ELECTRONIC DEVICE

FIELD OF THE INVENTION

The present invention relates generally to a speaker structure, and particularly to a removable speaker structure, which replaces the optical disk drive disposed originally in an electronic device.

BACKGROUND OF THE INVENTION

With the prosperous development of information technologies, the applications and development of relevant electronic and information produces become mature increasingly. In particular, computer systems and their associated peripheral industries make progress at a tremendous pace. A computer system uses the motherboard as the operating core and is accompanied by peripheral equipment. During the whole operating process, in addition to the calculating operations in the CPU, the support from peripheral devices, such as floppy disk drives (FD), hard disk drives (HDD), optical disk drives (CD-ROM), rewritable optical disk drives (CD-RW), and digital media players (DVD) is also required for reinforcing the functions of the computer system.

In addition, because notebook computers have become mature, their prices become reasonable and their sales grow. Under the influence of the decrease in the prices of key components, the market share of notebook computers has exceeded that of desktop computers. Besides, because the performance of notebook computers has been approaching that of desktop computers gradually and the Internet drives the demands for e-Business and mobile office, the market share of notebook computers will be increased substantially.

Because the quantity of production of notebook computers has increased significantly with almost identical functionality to desktop computers, the applications of peripheral equipment in notebook computers become indispensable. Nonetheless, due to their light and compact designs, notebook computers inherently have very limited available space. Currently, notebook computers use external equipment to conquer the problem of insufficient space in the circumstances when enhanced functions are required. By using this method, the problem of insufficient space for peripheral devices can be solved.

Moreover, for solving the problem of portability, the design of external peripheral devices bothers the users: they have to carry the peripheral devices and the related cables. The optical disk drives of current notebook computers are built-in or external with the purpose of reading optical disks. In most cases, optical disks are used for storing data. Nonetheless, most present storage media have already been replaced by cloud drives or portable hard drives with storage capacity significantly greater than optical disks, and hence making the use of current optical disk drives much less frequent. Thereby, there is no built-in optical disk drive in some notebook computers; the space for them is saved for reducing the size of the notebook computers.

Because notebook computers have become popular, they are not only used in processing data or browsing network. Currently, the multimedia design is usually added for highlighting products or enhancing attraction of information. In addition, stand-alone computer games or on-line games are also very popular; the design of games focuses on reinforcing visual and sound effects. Nonetheless, the space in notebook computers is quite limited; there is no room for disposing amplifiers or enlarging the size of resonant sound boxes.

Thereby, how to enhance the audio performance of notebook computers has become the major challenge for the manufacturers of notebook computers.

SUMMARY

An objective of the present invention is to provide a removable speaker structure for electronic device, which uses the space originally disposing the optical disk drive for a removable speaker module and thus enhancing the sound effects.

Another objective of the present invention is to provide a removable speaker structure for electronic device, which uses the fixing structure for originally disposing the optical disk drive for fixing the removable speaker module without adding additional mechanism.

Still another objective of the present invention is to provide a removable speaker structure for electronic device, which uses the electrical connecting structure originally between the optical disk drive and the computer for connecting electrically the removable speaker module and the computer without adding additional mechanism.

A further objective of the present invention is to provide an electronic device having removable speaker structure. The removable speaker module described above is disposed in the electronic device. Thereby, no additional mechanism is required. Besides, the removable speaker module can be switched with an optical disk drive.

For achieving the objectives and effects described above, the present invention discloses a removable speaker structure for electronic device. The space originally for the optical disk drive is used for disposing a removable speaker after the optical disk drive is removed. By means of the removable speaker, the sound effects of a notebook computer can be further improved. In addition, the removable speaker can use the fixing structure and the electrical connecting structure originally for the optical disk drive. It is not necessary to add these two mechanisms.

The present invention also discloses an electronic device having removable speaker. The electronic device has a removable speaker. After the removable speaker is first removed, an optical disk drive can be disposed in the space originally for the removable speaker. Besides, the optical disk drive can use the fixing structure and the electrical connecting structure for the removable speaker. It is not necessary to add these two mechanisms.

DETAILED DESCRIPTION

In order to make the structure and characteristics as well as the effectiveness of the present invention to be further understood and recognized, the detailed description of the present invention is provided as follows along with embodiments and accompanying figures.

The present invention is provided for solving the sound effect problems in the notebook computers according to the prior art. Without connecting to external speakers or amplifiers, it is hoped that sound effects can be improved and thus enhancing the multimedia effects of notebook computers. The present invention discloses a removable speaker for electronic device for improving the sound effects of notebook computers.

Figure 1:
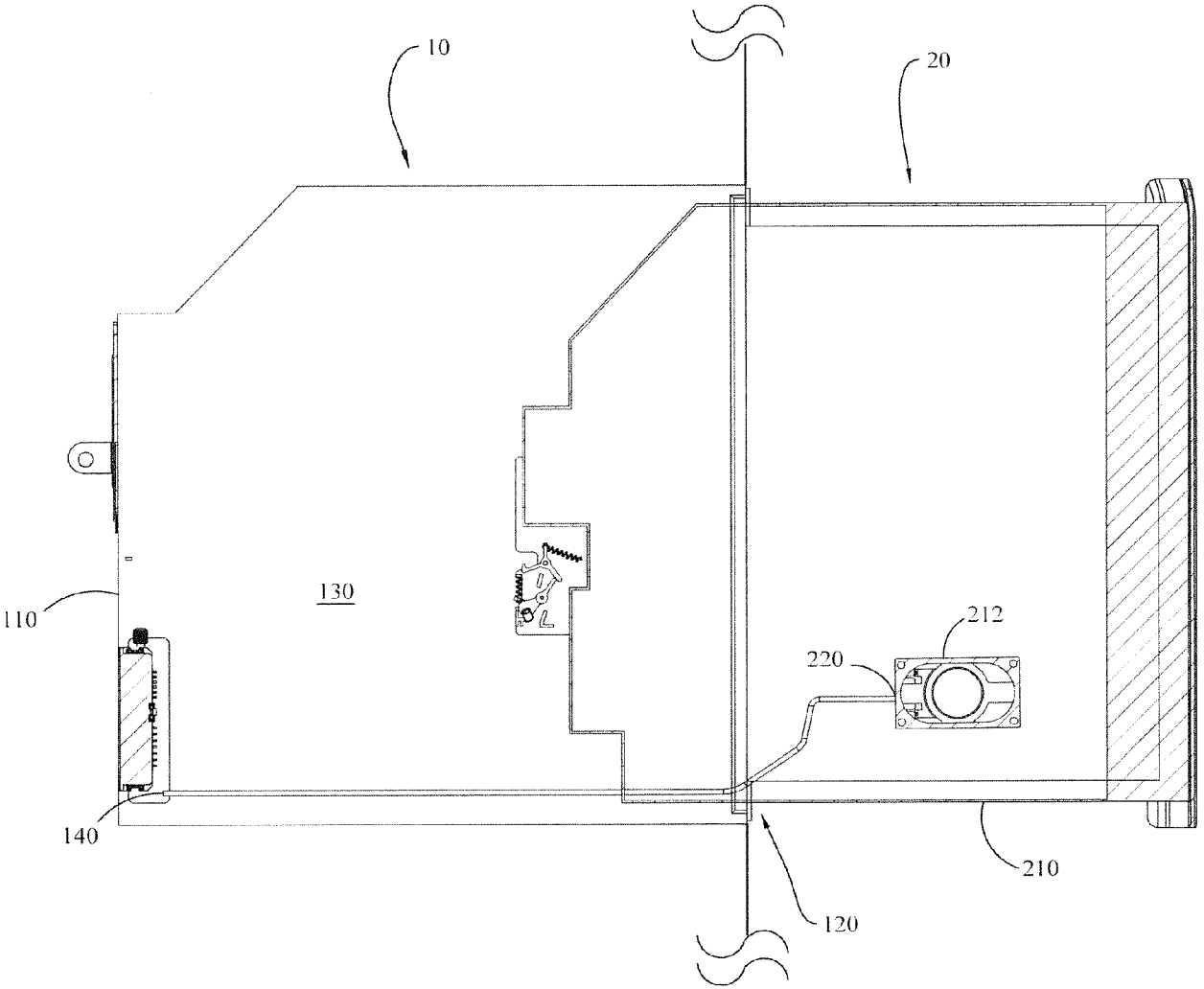
FIG. 1 shows a structural schematic diagram according to a preferred embodiment of the present invention.

First, FIG. 1 shows a structural schematic diagram according to a preferred embodiment of the present invention. As shown in the figure, the removable speaker structure for electronic device according to the present invention is applied to electronic devices such as notebook computers or to the docking stations of electronic devices, in which the space originally reserved for optical disk drives is used by the removable speaker structure. The structure according to the present invention comprises a main module 10 and a speaker module 20. Thereby, the speaker module 20 can be pushed forward from the inside of the electronic devices such as notebook computers or from the docking stations of electronic devices for improving the sound effects.

The main module 10 includes a main body 110, which has an opening 120 on one side and connecting to an accommodating space 130 inside the main body 110. A first electrical connecting port 140 is disposed on one side of the accommodating space 130. In addition, the speaker module 20 includes a housing 210 having at least a speaker 212 therein. A second electrical connecting port 220 is disposed on one side of the housing 210 and connected electrically to the speaker 212. The speaker module 20 is disposed in the accommodating space 130 so that the second electrical connecting port 220 is connected electrically with the first electrical connecting port 140.

Figure 2A:
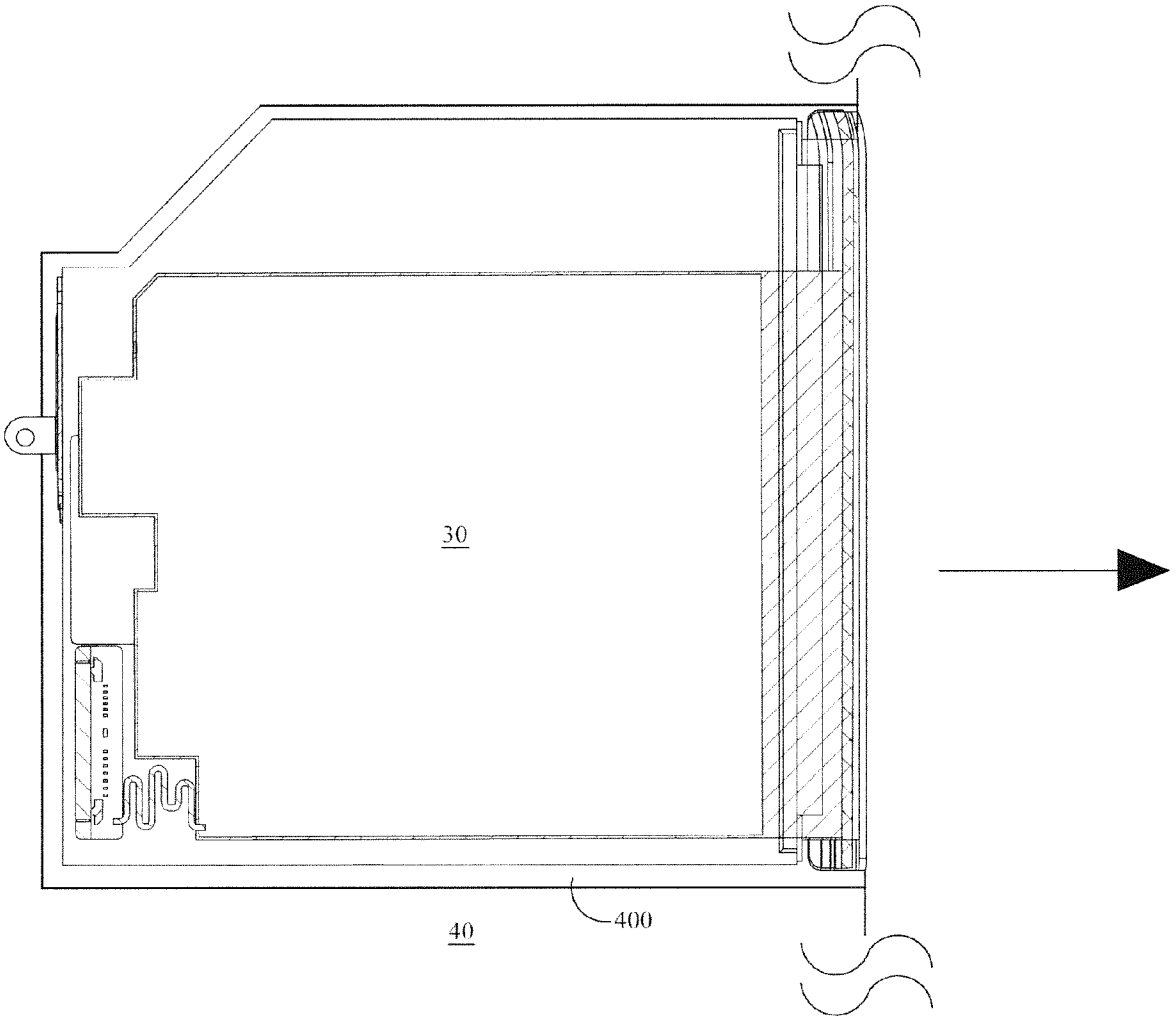
FIG. 2A shows a schematic diagram of removing the optical disk drive while installing the speaker module according to a preferred embodiment of the present invention.
Figure 2B:
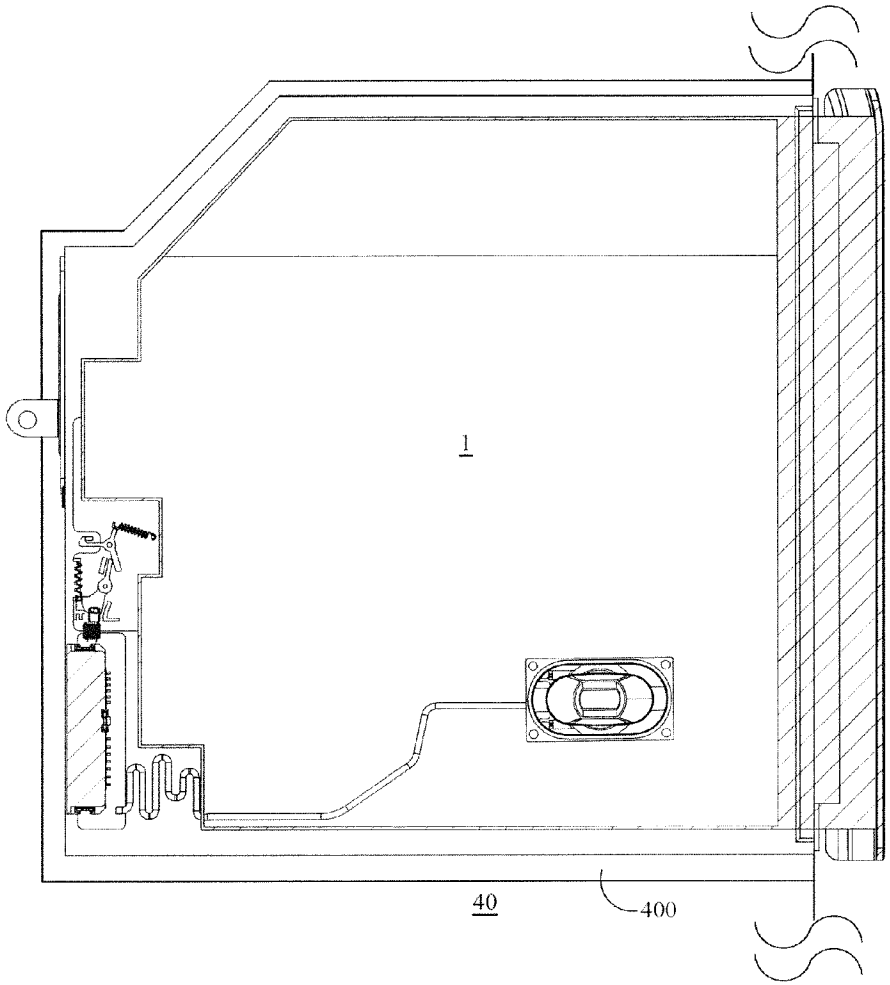
FIG. 2B shows a schematic diagram of installing the speaker module according to a preferred embodiment of the present invention.

FIGS. 2A and 2B show schematic diagrams of installing the speaker module according to a preferred embodiment of the present invention. As shown in the figures, the method for replacing the optical disk drive by the removable speaker module according to the present invention includes the following steps. First, an optical disk drive 30 is removed from a removable installation space 400 of the electronic device 40, as shown in FIG. 2A. Then the removable speaker 1 is placed. Thereby, the space of the optical disk drive 30 can be used for improving the sound effects of the electronic device 40. Besides, because the electrical connecting structure originally for the optical disk drive is used, while connecting electrically to the electronic device 40, no new electrical connecting structure is required. Moreover, the removable speaker 1 can be disposed to the removable installation space 400 contained in the electronic device 40 or the docking station by screwing or locking for fixing. This is not the technical feature of the present invention. Hence, the details will not be described further.

FIGS. 3A to 3D show operational diagrams of fixing and releasing the speaker module according to a preferred embodiment of the present invention. As shown in the figures, the speaker module 20 according to the present invention includes a first connecting device 230; the main module 10 includes a second connecting device 150. By means of the first and second connecting devices 230, 150, the speaker module 20 can be fixed to or released from the main module 10. The first connecting device 230 of the speaker module 20 according to the present invention comprises a first tension spring 232, a first connecting rod 234, a second connecting rod 236, and a second tension spring 238.

One side of the first tension spring 232 is disposed on one side of the housing 210. The first connecting rod 234 has a body 2340. One side of the body 2340 has a first rod member 2342, a second rod member 2344, and a third rod member 2346. The first rod member 2342 is connected with the other side of the first tension spring 232. The end of the second rod member 2344 has a hook 240. The body 2340 is connected pivotally to a first fixing pillar 242. The first fixing pillar 242 is disposed on the housing 210. The second connecting rod 236 is connected pivotally to a second fixing pillar 244 on the housing 210. One end of the second connecting rod 236 is connected with the third rod member 2346. One side of the other end of the second connecting rod 236 has a fixing member 2442; the other side of the other end of the second connecting rod 236 has a first magnetic member 2444. One end of the second tension spring 238 is connected with the fixing member 2442. The other end of the second tension spring 238 is connected with the housing 210. The first magnetic member 2444 is connected pivotally to a third fixing pillar 246 on the second connecting rod 236.

Moreover, the second connecting device 150 of the main module 10 according to the present invention includes a second magnetic member 1510 dispose on the body 110 and opposite to the first magnetic member 2444. Please refer to FIGS. 3A and 3B. To fix the speaker module 20 to the main module 10, while pushing the speaker module 20 in, the first magnetic member 2444 attract the second magnetic member 1510. At this moment, the attraction force therebetween should be greater than the force the second tension spring 238 holding the other end of the second connecting rod 236 then the other end of the second connecting rod 235 can be driven to rotate counterclockwise, which enables one end of the second connecting rod 236 to touch with a directing member 248. The first connecting rod 234, which is connected pivotally to the housing 210, is driven by the elastic recovery force of the first tension spring 232 to rotate and, drives the hook member 240 of the second connecting member 2344 to rotate clockwise and hook a fourth fixing pillar 250 on the housing 210. By the operations described above, the speaker module 20 can be fixed on the main module 10.

Figure 3A:
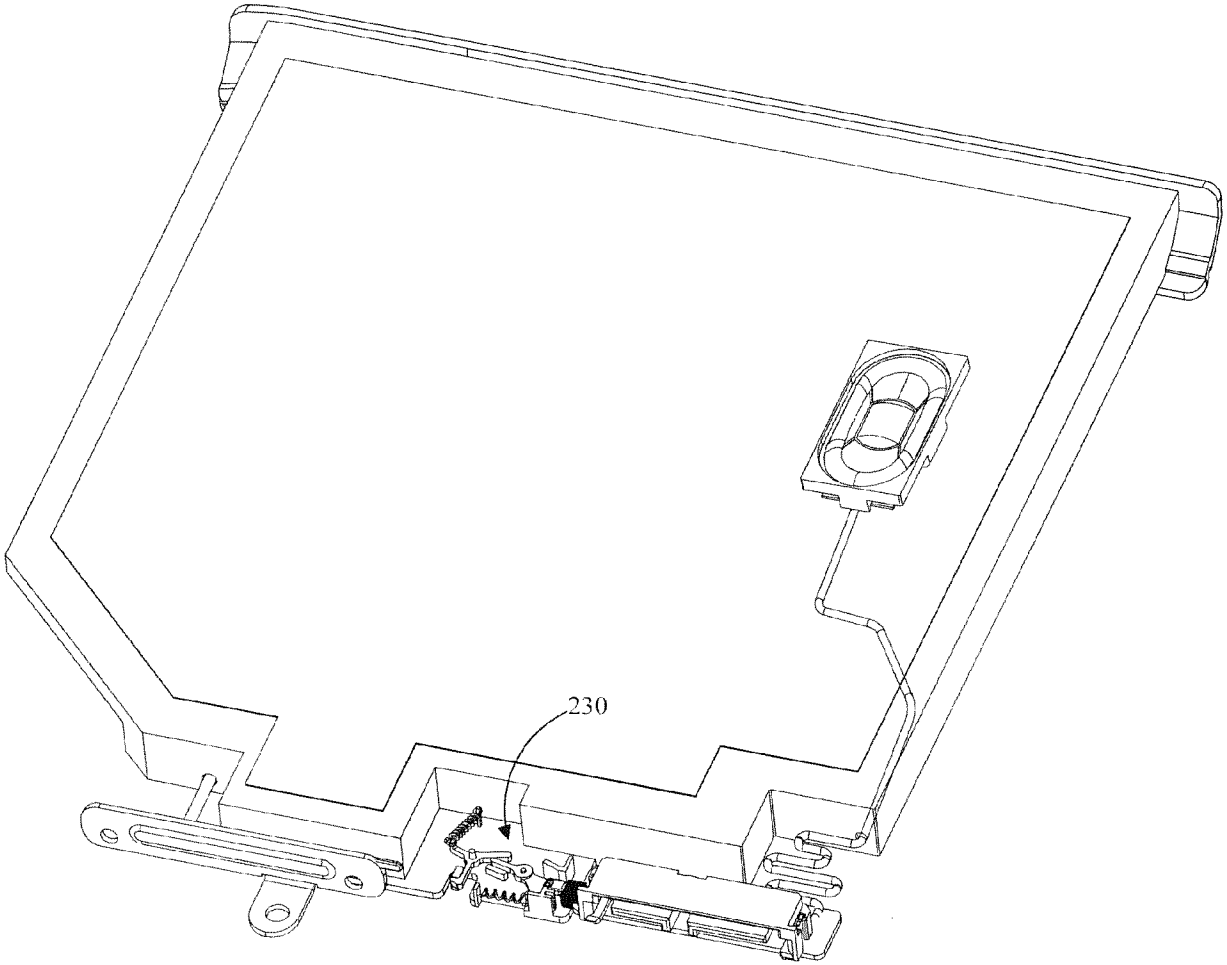
FIG. 3A shows an operational diagram of fixing the speaker module according to a preferred embodiment of the present invention.
Figure 3B:
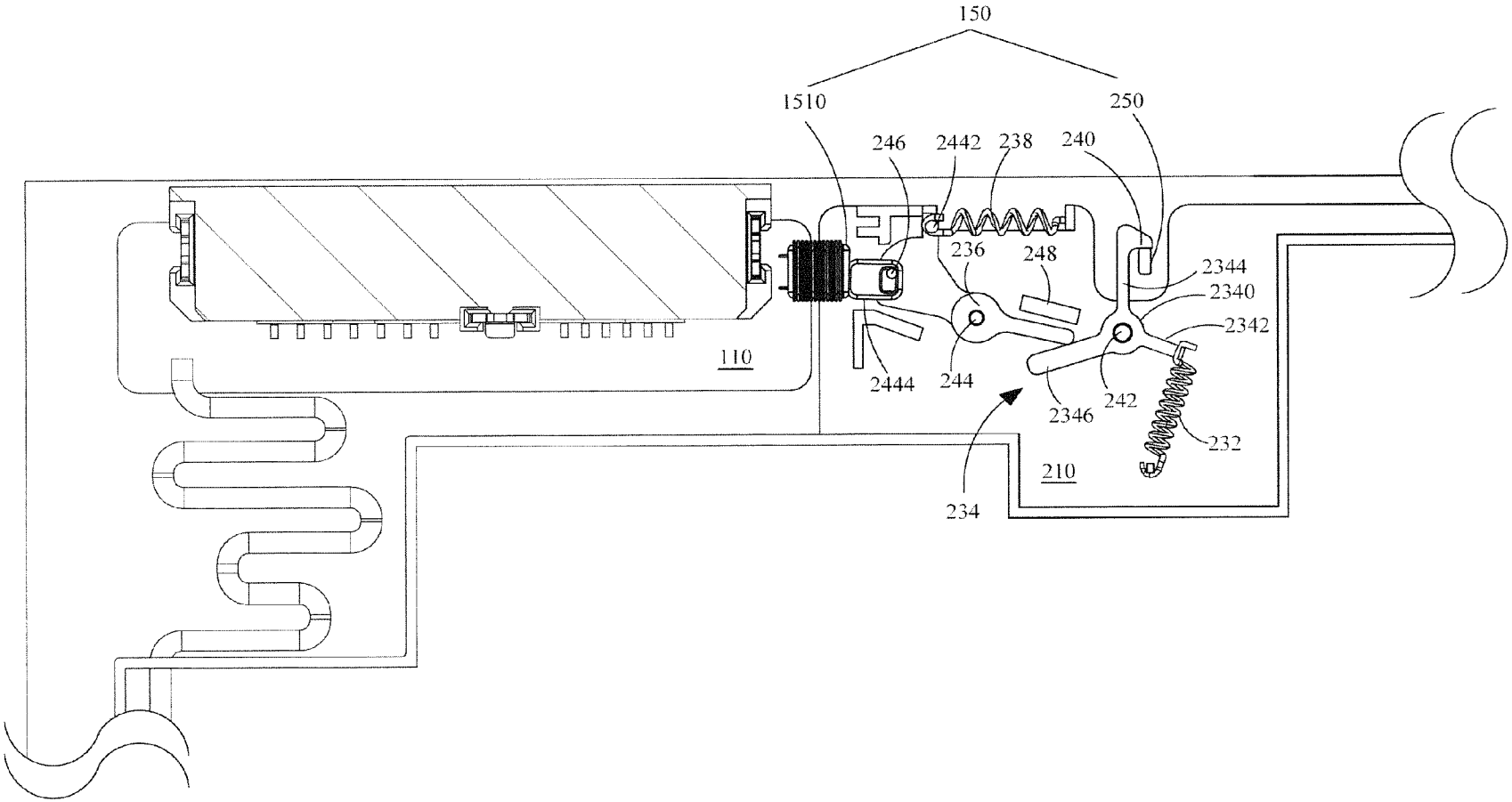
FIG. 3B shows a partially enlarged view of an operational diagram of fixing the speaker module according to a preferred embodiment of the present invention.
Figure 3C:
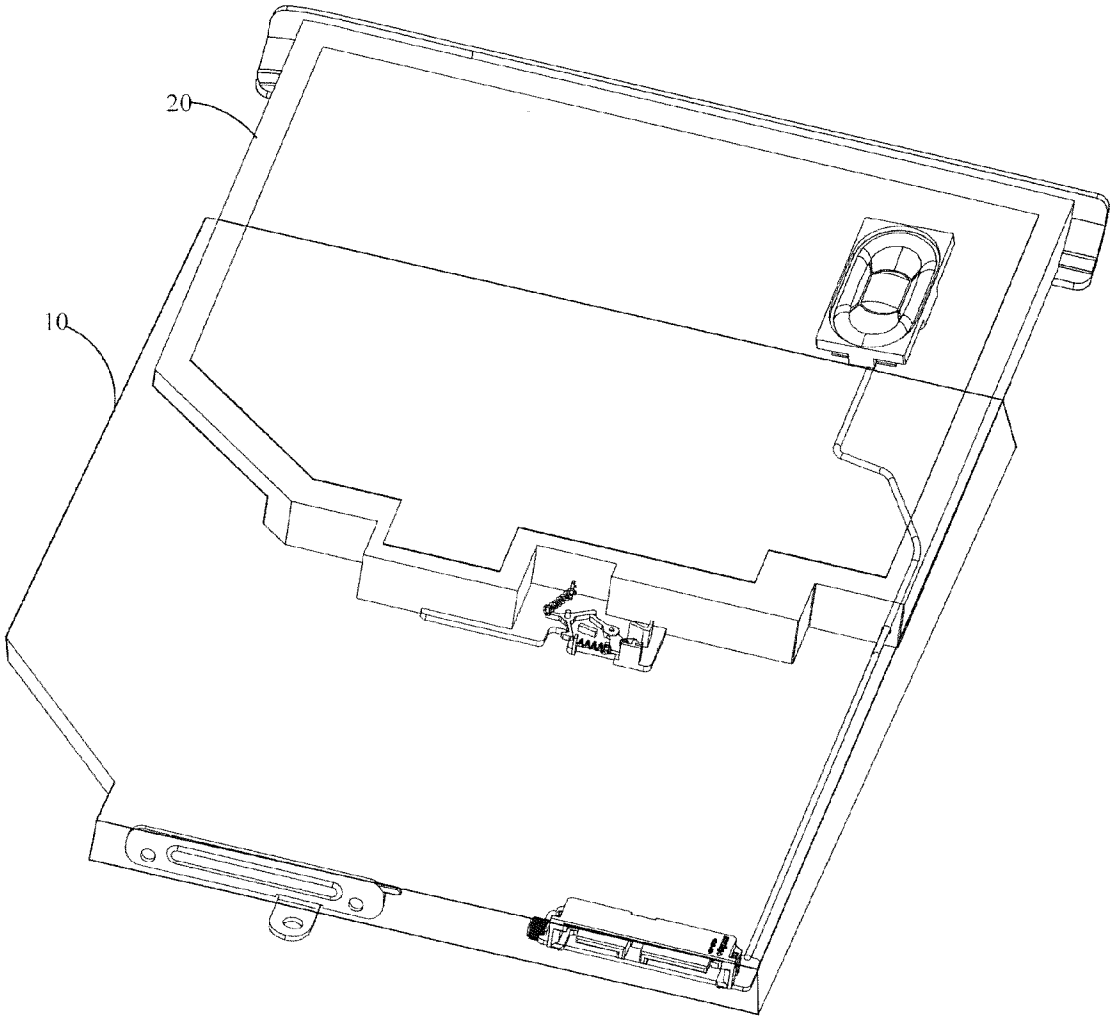
FIG. 3C shows an operational diagram of releasing the speaker module according to a preferred embodiment of the present invention.
Figure 3D:
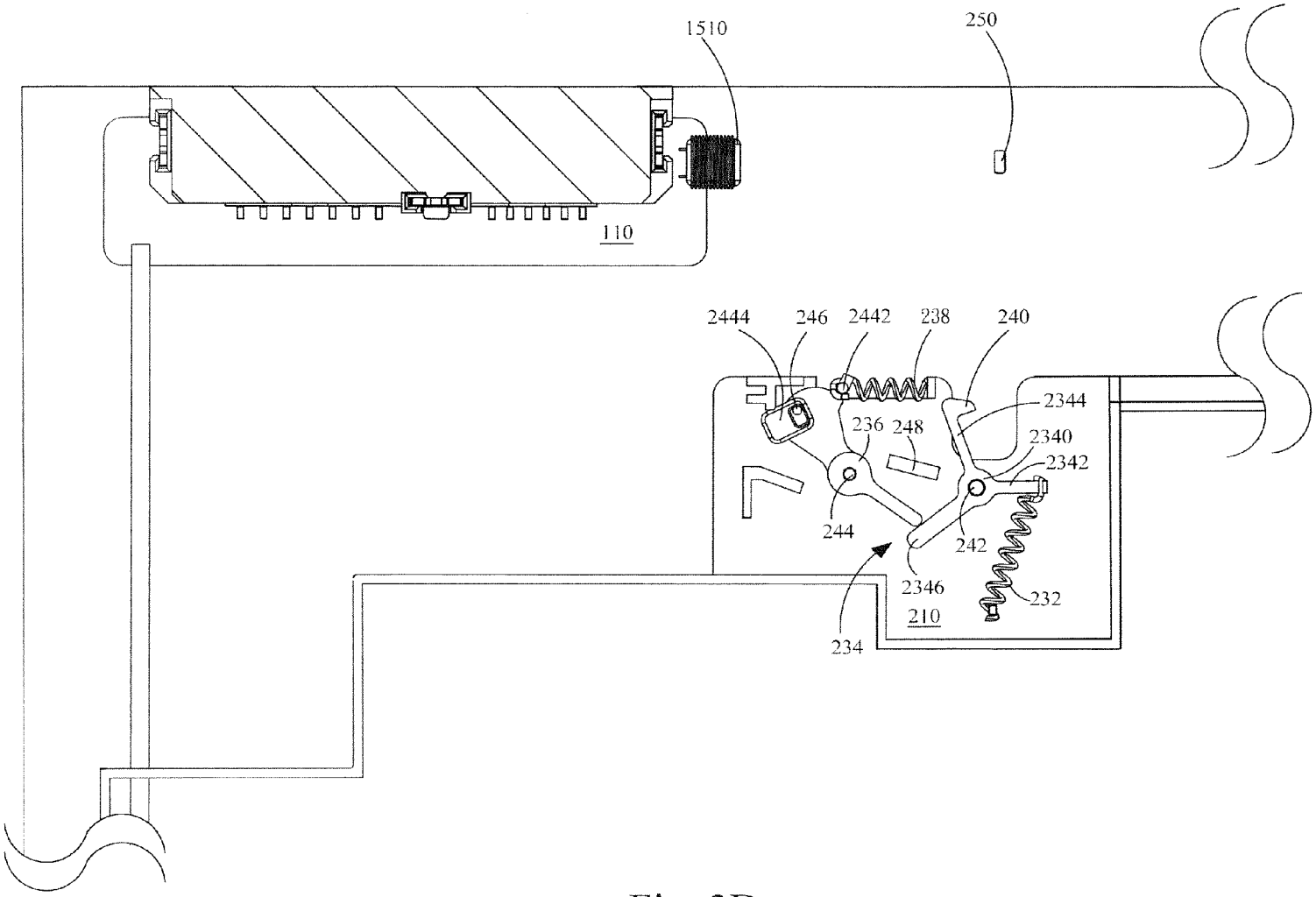
FIG. 3D shows a partially enlarged view of an operational diagram of releasing the speaker module according to a preferred embodiment of the present invention.

Next, please refer to FIG. 3 3C ad 3D. To release the speaker module 20 from the main module 10, a small current is applied to the second magnetic member 2444 for decreasing or reversing its magnetism. At this time, the attractive magnetic force between the first and second magnetic members 2444, 1510 is smaller than the elastic recovery force generated by the second tension spring 238, which makes the second tension spring 238 drive the second connecting rod 236 to rotate clockwise, one end of the second connecting rod 236 away from the directing member 248, and drive the third rod member 2346 of the first connecting rod 234 to rotate counterclockwise. Here, the pulling force generated by the elastic recovery force of the second tension spring 238 should be greater than the elastic recovery force of the first tension spring 232 then the first connecting rod 234 can rotate counterclockwise and the hook member 240 of the second rod member 2344 can move away from the fourth fixing pillar 250. Thereby, the speaker module 20 can depart from the main module 10. While playing multimedia sources, because the speaker module 20 has been removed from the main module 10, the sound can be played smoothly.

Figure 4A:
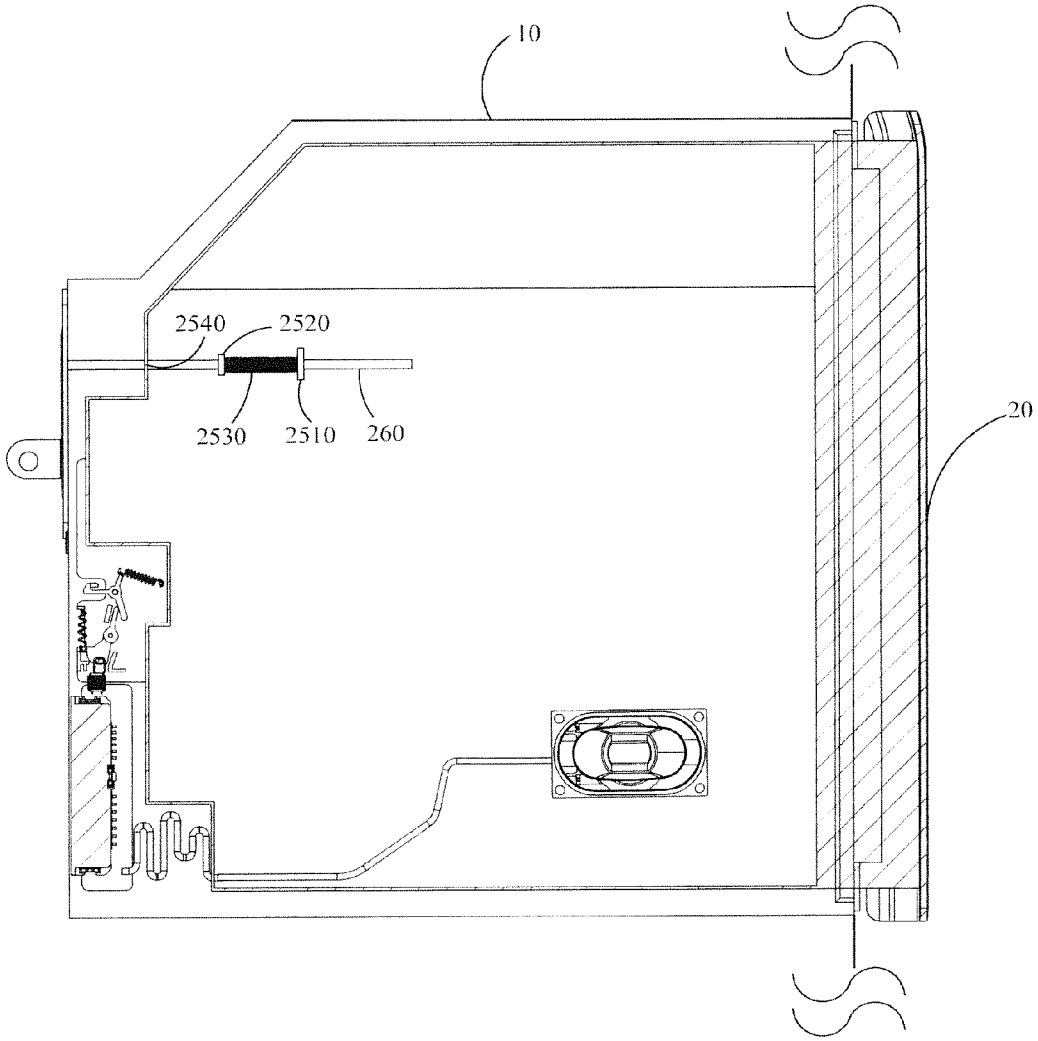
FIG. 4A shows a structural schematic diagram of the push member according to another preferred embodiment of the present invention.
Figure 4B:
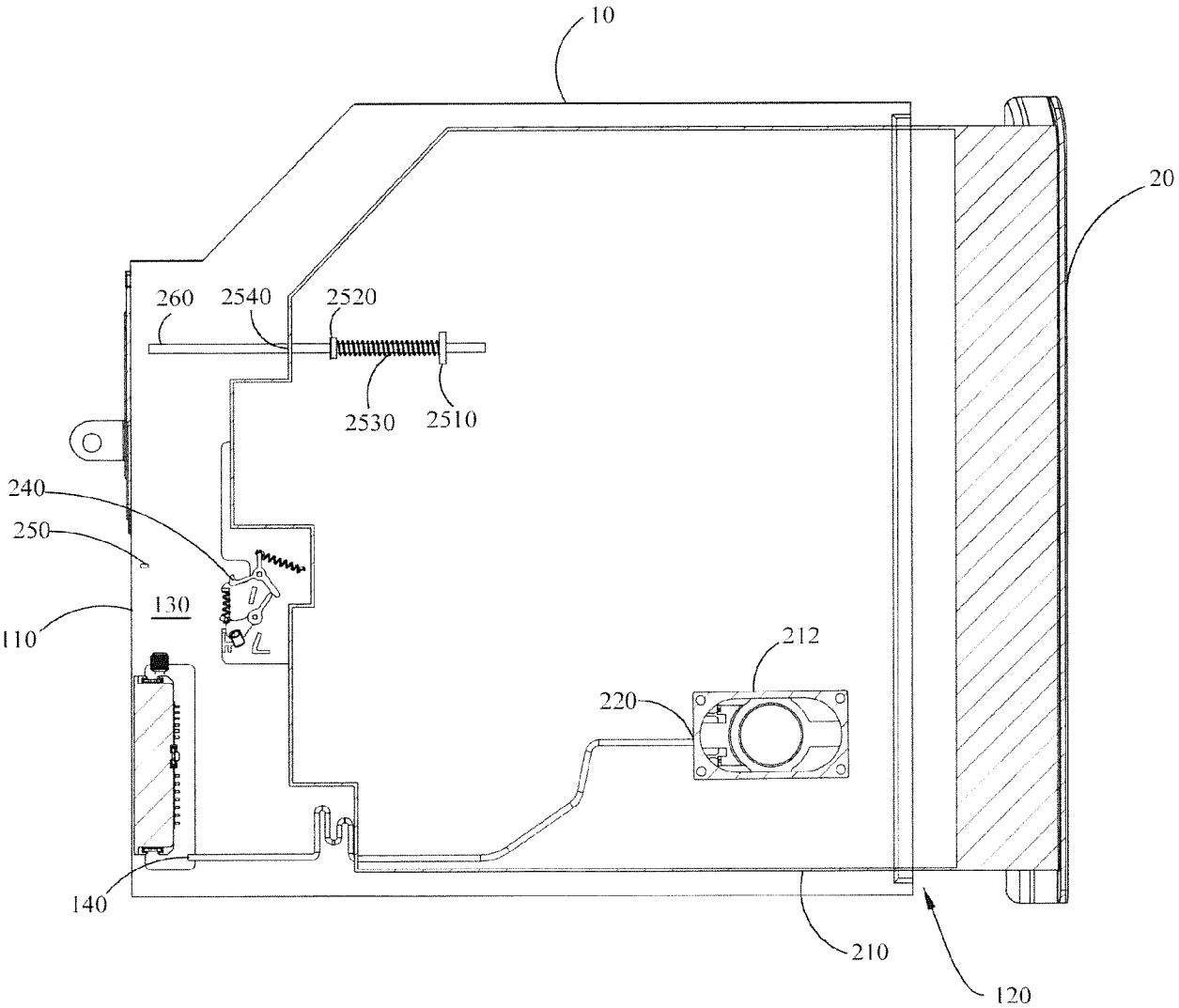
FIG. 4B shows an operational diagram of the push member according to another preferred embodiment of the present invention.

FIG. 4A and FIG. 4B show a structural schematic diagram and an operational diagram according to another preferred embodiment of the present invention. As shown in the figures, the present invention can further comprise a push member 260 for pushing the speaker module 20 away from the main module 10 and playing sound. A first stop member 2510 is disposed on the speaker module 20. The push member 260 passes through the stop member 2510. One end of the push member 260 has a second stop 2520. A spring 2530 is disposed between the first and second stop members 2510, 2520. The push member 260 is disposed projecting from the speaking module 20. A hole 2540 is disposed on the housing 210 of the main module 10. The push member 260 passes through the hole 2540. The second stop member 2520 is locate inside the hole 2540. In addition, the diameter of the second stop 2520 is greater than that of the hole 2540. Thereby, when the speaker module 20 is pushed into the main module 10 and the push member 260 touches the sidewall of the main module 10, the push member 260 will move towards the inside of the speaker module 20. At this time, the spring 2530 is blocked by the second stop member 2520 and compressed. By means of the mechanism in the embodiment described above, the speaker module 20 is fixed to the main module 10. Then it is the state when the speaker module 20 is fixed to the main module 10. As the hook member 240 moves away from the fourth fixing pillar 250, the speaker module 20 is no longer fixed to the main module 10. The push member 260 pushes the speaker module 20 to the opening 120 from the main module 10 by using the counterforce of the spring 2530. When the second stop member 2520 touches the hole 2540, the pushing operation is stopped. By disposing the push member 260, the speaker module 20 be pushed away from the main module 10 with convenience for playing multimedia sources.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A removable speaker structure, comprising:

a main module, having a body, one side of said body having an opening connected to an accommodating space inside said body, and one side of said accommodating space having a first electrical connecting port; and a speaker module, having a housing, said housing having at least a speaker inside said housing, one side of said housing having a second electrical connecting port connected to said speaker, and said speaker module disposed in said accommodating space so that said second electrical connecting port electrically connected to said first electrical connecting port, wherein said speaker module has a first connecting device on said housing and a second connecting device in said body, said first connection device attracts said second connection device magnetically by an attraction force while said main module is magnetically connected to said second connecting device of said speaker module via said first connecting device, magnetism of said second connection device is changed to be different from magnetism of said first connection device while said speaker module is released from said main module.

2. The removable speaker structure of claim 1, wherein said first connecting device comprising:

a first tension spring, with one side disposed on one side of said housing;

a first connecting rod, having a body, one side of said body having a first rod member, a second rod member, and a third rod member, said first rod member connected to the other side of said first tension spring, the end of said second rod member having a hook member, and said body connected pivotally to a first fixing pillar disposed on said housing;

a second connecting rod, connected pivotally to a second fixing pillar on said housing, having one end connected to said third rod member, one side of the other end of said second connecting rod having a fixing member, and the other side of the other end of said second connecting rod having a first magnetic member; and a second tension spring, having one end connected to said fixing member, and having other end connected to said housing.

3. The removable speaker structure of claim 2, wherein said first magnetic member is connected pivotally to a third fixing pillar of said second connecting rod.

4. The removable speaker structure of claim 2, and further comprising a fourth fixing pillar disposed on said body and connected with said hook member.

5. The removable speaker structure of claim 1, wherein said second connecting device including a second magnetic member disposed on said body and opposite to a first magnetic member.

6. The removable speaker structure of claim 5, wherein said second connecting device further includes a directing member disposed on said housing and connecting with one side of said second rod member.

7. The removable speaker structure of claim 1, wherein said speaker module has a first stop member; a push member passes through said first stop member; one end of said push member has a second stop member; and a spring is disposed between said first stop member and said second stop member.

8. The removable speaker structure of claim 7, wherein said housing has a hole; said push member passes through said hole; said second stop member is located inside said hole; and the diameter of said second stop member is greater than the diameter of said hole.

9. The removable speaker structure of claim 2, wherein the pulling force of said first tension spring is smaller than the pulling force of said second tension spring.

10. An electronic device having removable speaker, comprising:

an electronic device, comprising a removable installation space; and a removable speaker, disposed in said removable installation space, and comprising:

a main module, having a body, one side of said body having an opening connected to an accommodating space inside said body, and one side of said accommodating space having a first electrical connecting port; and a speaker module, having a housing, said housing having at least a speaker inside said housing, one side of said housing having a second electrical connecting port connected to said speaker, and said speaker module disposed in said accommodating space to enable electrical connection between said second electrical connecting port and said first electrical connecting port, wherein said speaker module has a first connecting device on said housing and a second connecting device in said body, said first connection device attracts said second connection device magnetically by an attraction force while said main module is magnetically connected to said second connecting device of said speaker module via said first connecting device, magnetism of said second connection device is changed to be different from magnetism of said first connection device while said speaker module is released from said main module.

11. The electronic device having removable speaker of claim 10, wherein an optical disk drive is placed in said removable installation space.

* * * * *